US008721017B2

(12) United States Patent
Yamaguchi et al.

(10) Patent No.: US 8,721,017 B2
(45) Date of Patent: May 13, 2014

(54) PRINTING APPARATUS AND PRINTING METHOD

(71) Applicant: Canon Kabushiki Kaisha, Tokyo (JP)

(72) Inventors: Hiromitsu Yamaguchi, Kanagawa (JP); Makoto Akihira, Kanagawa (JP); Satoshi Wada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/033,668

(22) Filed: Sep. 23, 2013

(65) Prior Publication Data

US 2014/0015888 A1 Jan. 16, 2014

Related U.S. Application Data

(62) Division of application No. 12/490,157, filed on Jun. 23, 2009, now Pat. No. 8,567,886, which is a division of application No. 10/799,193, filed on Mar. 12, 2004, now abandoned.

(30) Foreign Application Priority Data

Mar. 17, 2003 (JP) ..... 2003-072605

(51) Int. Cl.
*B41J 29/38* (2006.01)

(52) U.S. Cl.
USPC ..... 347/9; 347/41

(58) Field of Classification Search
USPC ..... 347/9–12, 13, 14, 15, 40–43, 49, 54, 57
See application file for complete search history.

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,723,129 | A | 2/1988 | Endo et al. |
| 4,740,796 | A | 4/1988 | Endo et al. |
| 6,217,149 | B1 | 4/2001 | Takagi et al. |
| 6,352,327 | B1 | 3/2002 | Yano et al. |
| 6,439,687 | B1 | 8/2002 | Inoue |
| 6,598,951 | B2 | 7/2003 | Ikemoto et al. |
| 6,631,963 | B1 | 10/2003 | Ando et al. |
| 6,890,060 | B2 | 5/2005 | Yakura et al. |

(Continued)

FOREIGN PATENT DOCUMENTS

JP 2001-199074 9/2001

*Primary Examiner* — Thinh Nguyen
(74) *Attorney, Agent, or Firm* — Fitzpatrick, Cella, Harper & Scinto

(57) ABSTRACT

The present invention forms a high-quality image by using a print head, in which a plurality of arrayed small heads, each having a plurality of print elements arranged in columns, are arranged so that at least two sets of print elements in adjoining small heads are aligned in a scan direction. The print head and a print medium are moved relative to each other in the scan direction crossing a direction of the print element columns. The print elements are divided into a plurality of drive blocks and activated the drive blocks on a time-division basis. The small heads each have the plurality of print elements arranged in columns, the number of print elements being equal to an integer times the number of time-division drive blocks. Drive timings with which to activate the paired print elements aligned in the scan direction are the same time-division drive timing.

18 Claims, 15 Drawing Sheets

(56) References Cited

U.S. PATENT DOCUMENTS

| | | | | |
|---|---|---|---|---|
| 7,207,650 | B2 | 4/2007 | Ikemoto et al. | |
| 7,677,693 | B2 | 3/2010 | Jeon et al. | |
| 8,256,862 | B2 | 9/2012 | Takagi et al. | |
| 8,534,788 | B2 * | 9/2013 | Masada et al. | 347/12 |

* cited by examiner

INK DOT FORMED BY INK EJECTED FROM CHIP C1

INK DOT FORMED BY INK EJECTED FROM CHIP C2

INK DOT FORMED BY INK EJECTED FROM CHIP C1

INK DOT FORMED BY INK EJECTED FROM CHIP C2

PRINTING APPARATUS AND PRINTING METHOD

The present application is a division of U.S. patent application Ser. No. 12/490,157 filed Jun. 23, 2009, which is a division of U.S. patent application Ser. No. 10/799,193 filed on Mar. 12, 2004, which claims priority from Japanese Patent Application No. 2003-072605 filed Mar. 17, 2003, which is incorporated hereinto by reference.

BACKGROUND OF THE INVENTION

1. Field of the Invention

The present invention relates to a printing apparatus and a printing method that perform printing by using a print head having a plurality of print elements arranged in columns, and more particularly to a printing apparatus and a printing method suitably applied to cases where a so-called full multi-type ink jet print head with a large number of ink nozzles arrayed over a relatively long range is used.

2. Description of the Related Art

Printing apparatus used in printers and copying machines and printing apparatus used as output devices for composite electronic devices including computers and word processors and for workstations are constructed to form images (including characters and symbols) on a print medium such as a paper and a thin plastic sheet according to print information (printing information). These printing apparatus may be classified into an ink jet system, a wire dot system, a thermal system and a laser beam system according to the printing method employed.

The printing apparatus may also be grouped into a serial type and a line type in terms of a printing action. In the serial type, a print head as a printing means is scanned over a print medium in a main scan direction that crosses a subscan direction in which the print medium is transported. That is, an entire area of the print medium is printed by repetitively feeding the print medium a predetermined distance each time the print head completes one main scan printing.

In the line type, printing is done by moving only the print medium in the subscan direction without moving the print head in the main scan direction. This type of printing apparatus prints an entire area of the print medium by first setting the print medium at a predetermined position and then feeding the print medium in the subscan direction while at the same time printing lines of print data, one line at a time, on the print medium.

Of these types of printing apparatus, the ink jet printing apparatus performs printing by ejecting ink from nozzles of a printing means (print head) onto a print medium. The ink jet printing apparatus has many advantages, such as an ease with which the print head can be reduced in size, an ability to print a high resolution image at high speed, an ability to print on plain paper without having to apply a special treatment to it, a low running cost, low noise realized by a non-impact printing, and an ease with which a color image can be printed using multiple color inks. In a line type ink jet printing apparatus which uses a full multi-type print head having a large number of print elements arrayed in a width direction of the print medium (in a direction crossing, normally at right angles to, the print medium transport direction), a further increase in the printing speed can be achieved. Further, the line type printing apparatus is attracting attention because of a possibility of it being used as an on-demand type printer for which there is a growing demand in the market. The print elements are arranged to span a full width of a print area of the print medium and eject ink from the nozzles.

Unlike conventional printing of newspapers and magazines which is required to print millions of copies, the on-demand printing is not required to have such a high speed printing capability as 100,000 sheets per hour but is called upon to reduce labor. The full multi-type line printer, though its printing speed is far slower than that of a conventional printing press such as offset printer, can save labor because there is no need to make a printing plate and is thus optimal for on-demand printing.

The full multi-type line printer for use in such on-demand printing is required to produce printed mediums of A3 size at a rate of 30 pages or more per minute at a resolution of 600×600 dpi (dots per inch) for mono-color text documents and at a high resolution of 1200×1200 dpi or higher for full color photographs and the like.

In a print head used on the abovementioned full multi-type printer, however, forming all ink jet print elements arranged to span the full width of a print area of the print medium, particularly nozzles constituting a part of the ink jet print elements, without any defects is not an easy task. For example, in a full multi-type printer that produces photographic quality outputs on large-sized paper, such as those used in offices, to print a 1200-dpi outputs on A3-size paper requires forming about 14,000 nozzles in a full multi-type print head (with a print width of about 280 mm). It is difficult to manufacture all the ink jet print elements corresponding to such a large number of nozzles without any defects. Even if such a print head can be manufactured, it is easily conceivable that a yield may be low and a manufacturing cost prohibitively high.

To deal with this problem a so-called combined head is proposed as the full multi-type print head for use in the line type ink jet printing apparatus. The combined head is made by joining end-to-end a plurality of relatively inexpensive, short chip-type print heads, such as those used in a serial type, in a longitudinal direction of nozzle array or column with a high precision to increase the length of the print head.

Because of this construction, however, the combined head has a problem that those portions of a printed result corresponding to the print elements situated at joints between the chips tend to be degraded. In more concrete terms, any deviation in the arrangement of chips may result in pitches between adjoining nozzles (simply referred to as nozzle pitches) at the joints failing to agree with those of other nozzles. Should this take place, density variations that look like stripes or bands (joint stripes) appear on a printed image at locations corresponding to the joints between the chips.

To address these joint stripes some countermeasures have been proposed.

For example, a method is available which reduces the nozzle pitch deviations by using a particular chip arrangement technique or device that aligns chips at the joints with high precision. Another chip arrangement method involves staggering the chips in a print medium transport direction and overlapping the adjoining chips by a predetermined number of nozzles at chip ends. In this case, during printing, the overlapping nozzles of both of the adjoining chips are made to eject ink to make the joint stripes less conspicuous. Still another method is to change the volume of ink droplets ejected from the nozzles at the joints to make the joint stripes less conspicuous.

These methods, however, cannot reduce the joint stripes to an acceptable level when producing a photographic quality print.

SUMMARY OF THE INVENTION

An object of the present invention is to provide a printing apparatus and a printing method, which can print high-quality images by using a print head that has a plurality print elements arranged in columns and which has at least two of the print elements aligned in a scan direction crossing a direction of columns of the print elements.

In the first aspect of the present invention, there is provided a printing method for forming an image by using a print head, wherein the print head has a plurality of arrayed small heads, the small heads each have a plurality of print elements arranged in columns, the print elements are equal in number to an integer times the number of time-division drive blocks, and the small heads are arranged so that at least two print elements in adjoining small heads are aligned in a scan direction;

the printing method comprising the steps of:

moving the print head and a print medium relative to each other in the scan direction that crosses a direction of the columns of the print elements; and dividing the print elements into the plurality of drive blocks and activating the drive blocks of print elements on a time-division basis to form an image on the print medium;

wherein drive timings with which to activate the set of print elements aligned in the scan direction are the same time-division drive timing.

In the second aspect of the present invention, there is provided a printing apparatus for forming an image by using a print head, the printing apparatus; wherein the print head has a plurality of arrayed small heads, the small heads each have a plurality of print elements arranged in columns, the print elements are equal in number to an integer times the number of time-division drive blocks;

the print head and a print medium are moved relative to each other in a scan direction that crosses a direction of the columns of the print elements;

the print elements are divided into the plurality of drive blocks and activated in the drive blocks on a time-division basis to form an image on the print medium;

at least two print elements in adjoining small heads are aligned in the scan direction; and the number of sets or pairs of print elements in the adjoining small heads aligned in the scan direction is equal to an integer times the number of time-division drive blocks.

In the third aspect of the present invention, there is provided a print head for forming an image, comprising:

a plurality of arrayed small heads, the small heads each having a plurality of print elements arranged in columns, the print elements being equal in number to an integer times the number of time-division drive blocks;

wherein the print head and a print medium are moved relative to each other in a scan direction that crosses a direction of the columns of the print elements;

wherein the print elements are divided into the plurality of drive blocks and activated in the drive blocks on a time-division basis to form an image on the print medium;

wherein at least two print elements in adjoining small heads are aligned in the scan direction;

wherein the number of sets of print elements in the adjoining small heads aligned in the scan direction is equal to an integer times the number of drive blocks.

In the fourth aspect of the present invention, there is provided a program for forming an image by using a print head, wherein the print head has a plurality of arrayed small heads, the small heads each have a plurality of print elements arranged in columns, the print elements are equal in number to an integer times the number of time-division drive blocks, and the small heads are arranged so that at least two print elements in adjoining small heads are aligned in a scan direction, the program causing a computer to execute the steps comprising:

moving the print head and a print medium relative to each other in the scan direction that crosses a direction of the columns of the print elements;

dividing the print elements into the plurality of drive blocks and activating the drive blocks of print elements on a time-division basis to form an image on the print medium; and activating the set of print elements aligned in the scan direction at the same time-division drive timing.

In the fifth aspect of the present invention, there is provided a storage media readable by a computer and storing the program of the fourth aspect of the present invention.

With the present invention an image is printed on a print medium by using a print head having a plurality of print elements arranged in columns and by moving the print head and the print medium relative to each other in the scan direction crossing a direction of print element columns while at the same time driving the print elements.

In the print head, at least two of the plurality of print elements in short chips (small heads) are aligned in the scan direction. The plurality of print elements are divided into a plurality of drive blocks and are driven in blocks on a time-division basis. The number of overlapping print elements in a joint portion of adjoining chips, as counted in the print element column direction, is set equal to an integer times the number of time-division drive blocks. When the print elements aligned in the scan direction are activated at a predetermined ratio for printing, the drive timings with which to activate the print elements aligned in the scan direction are set to the same timing after a predetermined interval.

In this specification, a word "print (record)" signifies not only forming significant information such as characters and figures but also generally forming images, patterns or the like on a variety of print mediums, whether the information is significant or nonsignificant or whether visible or latent, or processing the mediums.

A word "print medium" applies not only to paper commonly used in ink jet printing apparatus but also any kind of materials that can receive ink ejected from print head, such as cloth, plastic films and metal sheets.

Further, a word "ink" should be construed broadly as in the case of "print (record)" and refers to a liquid used to form images, patterns or the like by being applied to a print medium or to process the print medium.

With the present invention, a high-quality image can be printed by using a print head, which has a plurality of print elements arranged in columns and which also has at least two of them aligned in a scan direction crossing a direction of print element columns, and by setting the drive timings of the print elements aligned in the scan direction to the same timing after a predetermined interval.

Particularly when an elongate print head having a plurality of arrayed chips (so-called elongate combined head) is used as a so-called full multi-type ink jet print head in which a large number of ink nozzles are arranged in a relatively long range, the present invention can prevent degradations of those printed areas corresponding to joint portions of the chips and thereby produce a high-quality image. Further, by using a so-called combined or joined head that combines relatively inexpensive short heads into an elongate print head, an ink jet printing apparatus capable of producing high-quality images can be provided easily and at low cost.

Further, as in embodiments described later, when a print head used is made up of a plurality of small heads each having a plurality of print elements arranged in columns, it is possible to divide the print elements in each small head into a predetermined number of drive blocks and activate these blocks on a time-division basis. In that case, the drive timings with which to activate those print elements in adjoining small heads which are aligned in the scan direction can be set to the same timing, thereby simplifying the construction of the print head. That is, since the number of print elements in each small head is equal to an integer times the number of time-division drive blocks, it is possible to form drive circuits for the print elements in the small heads, including those in the adjoining small heads aligned in the scan direction, in regular patterns and therefore make the control of the individual print elements easier.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described by referring to the accompanying drawings.

First Embodiment

Figure 1:
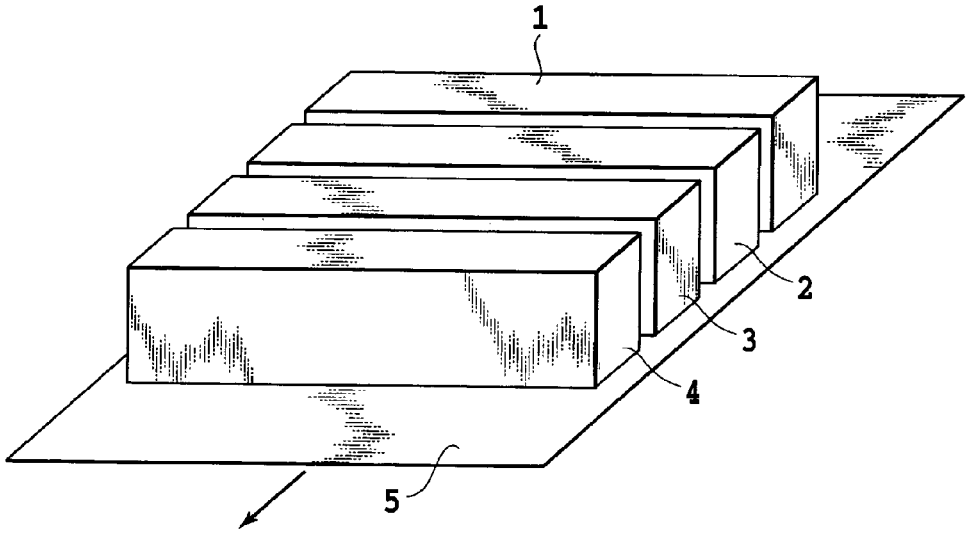
FIG. 1 schematically illustrates a construction of an ink jet printing apparatus to which the present invention is applicable.

FIG. 1 is a perspective view showing a conceptual construction of an ink jet printing apparatus according to one embodiment of the present invention. A head unit comprises a plurality of elongate ink jet print heads 1, 2, 3, and 4, each of which has a plurality of ink jet print elements to eject ink from their nozzles. These print heads 1, 2, 3, and 4 are elongate print heads for ejecting black (K), cyan (C), magenta (M) and yellow (Y) inks, respectively. The print heads are connected with ink supply tubes not shown and also with a flexible cable not shown through which they receive control signals. A print medium 5 is held by transport rollers and discharge rollers, not shown, and is fed in a direction of arrow (main scan direction) by a driving force of a transport motor. For example, the print medium 5 is plain paper, special high grade paper, OHP sheet, glossy paper, glossy film, or postcard. The ink jet print elements each include a nozzle and an ink ejection energy generation element provided at the nozzle. The ink jet print elements in this embodiment each have installed in their liquid path a heating element (electrothermal transducer) for generating thermal energy to eject ink. In synchronism with a read timing with which a linear encoder (not shown) detecting the position of the print medium 5 being fed is read, the heating elements are driven according to a print signal to eject ink droplets from the corresponding nozzles onto the print medium 5. The ink droplets that landed on the print medium 5 form an image.

The ink jet print heads, when not printing, have their nozzle faces hermetically enclosed with a cap portion of a capping means not shown. This prevents a possible clogging of nozzles caused by solidified ink from evaporation of ink solvent or by adhesion of foreign matter such as dust.

The cap portion of the capping means may also be used for idle ejections (preliminary ejections) in which ink not contributing to the image printing is ejected from the nozzles toward the cap portion to prevent possible ejection failures or clogging of those nozzles with a low frequency of use. It is also possible to introduce a negative pressure produced by a pump not shown into an interior of the activated cap portion hermetically enclosing the nozzle faces, to suck ink not contributing to the image printing from the nozzles of the print heads out into the interior of the cap portion, thereby reinstating the ink ejection performance of the failed nozzles. Further, the nozzle faces of the print heads may be cleaned (wiped) with a blade (wiping member) not shown, installed adjacent to the cap portion.

Figure 2:
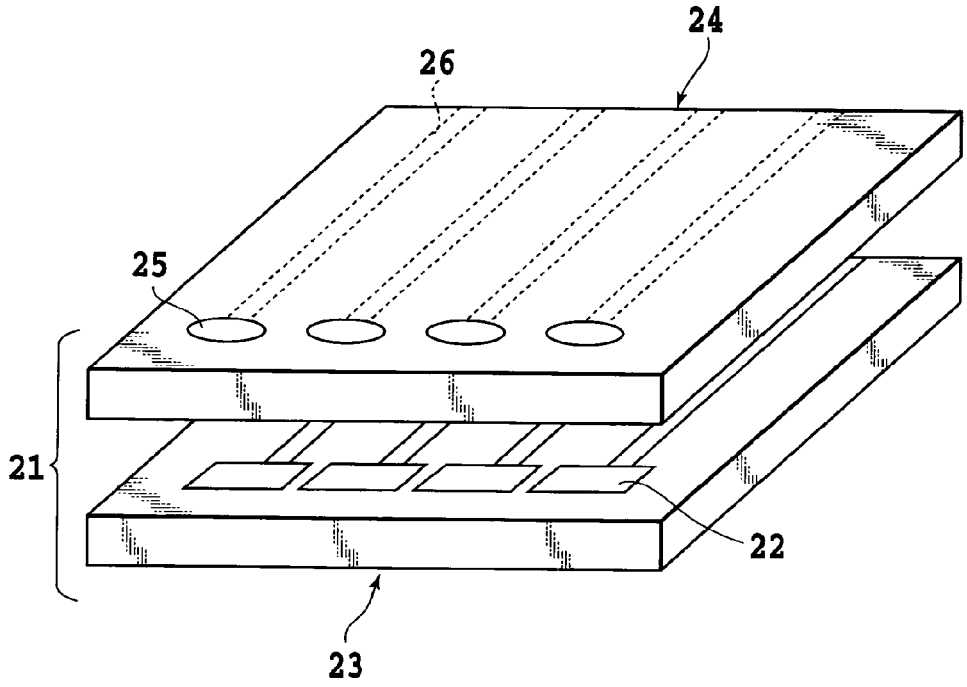
FIG. 2 is an exploded perspective view of a print head to which the present invention is applicable.

FIG. 2 is an exploded perspective view showing an essential portion of the ink jet print head described above.

The ink jet print head 21 mainly comprises a heater board 23 on which a plurality of heaters (heating elements) 22 for heating ink are formed and a top plate 24 put over the heater board 23. The top plate 24 has a plurality of nozzles 25 formed therein and a plurality of tunnel-like liquid paths 26 formed behind, and connected to, the associated nozzles 25. Rear ends of the liquid paths 26 are connected to a common ink chamber, which is supplied ink through an in supply port. The ink is now supplied from the ink chamber to the individual liquid paths 26. The nozzles 25 form openings through which the ink is ejected.

The heater board 23 and the top plate 24 are assembled together, as shown in FIG. 2, so that the heaters 22 are situated at positions facing the associated liquid paths 26. FIG. 2 representatively shows four sets of nozzles 25, heaters 22 and liquid paths 26, with each liquid path 26 assigned with one heater 22. In the print head 21 assembled as shown in FIG. 2, a selected heater 22 is applied a predetermined drive pulse to boil ink over the heater 22 and form a bubble which, as it expands, expels ink from the nozzle 25.

The ink jet printing system of the present invention is not limited to a bubble jet system that uses heaters shown in FIG. 1 and FIG. 2 but can also be applied to a wide range of print heads having various types of ink jet print elements. For example, in the case of a continuous type that continuously ejects ink droplets, a charge control system and a diffusion control system may be applied. In the case of an on-demand type that ejects ink droplets only when demanded, a pressure control system may be employed which ejects ink droplets from nozzles by mechanical vibrations of piezoelectric elements.

Figure 3:
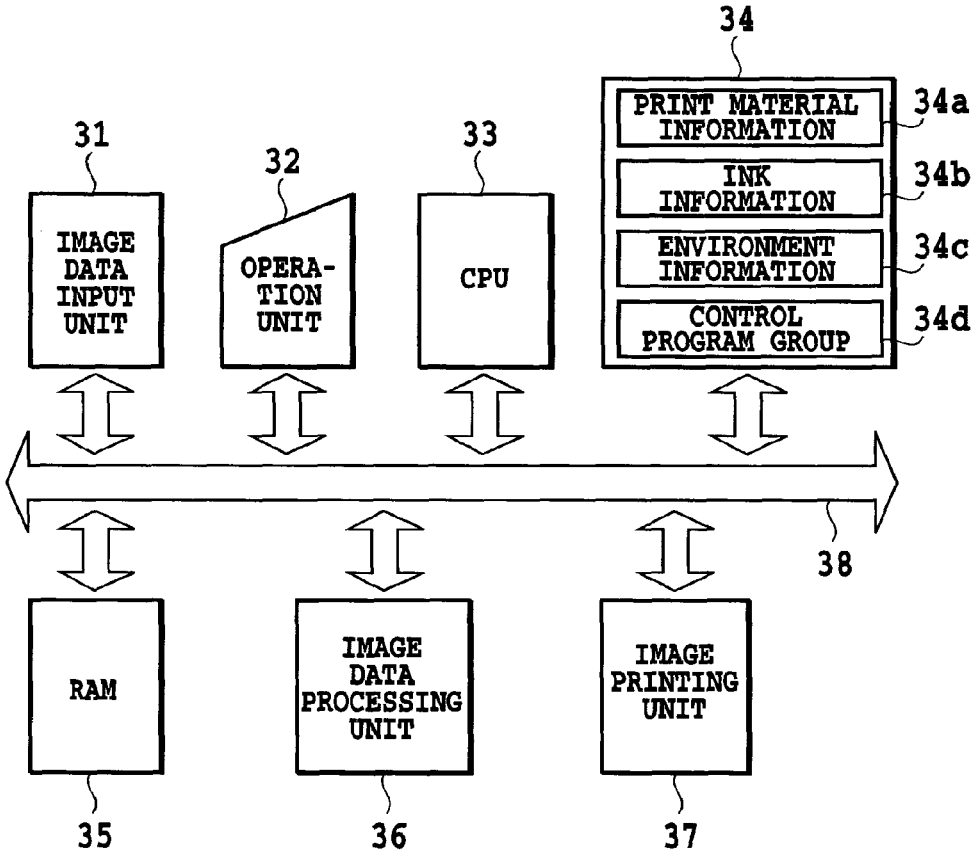
FIG. 3 is a block diagram showing a control system in the ink jet printing apparatus of FIG. 1.

FIG. 3 shows a block diagram showing an example configuration of a control system for the ink jet printing apparatus according to the present invention.

In FIG. 3, reference numeral 31 denotes an image data input unit, 32 denotes an operation unit, 33 denotes a CPU for performing various processing, and 34 denotes a storage media for storing a variety of data. A print information memory in the storage media 34 stores information 34*a* on a kind of print medium, information 34*b* on ink used for printing, and information 34*c* on environment such as temperature and humidity during printing. Denoted 34*d* is a group of control programs. Reference number 35 denotes a RAM, 36 denotes an image data processing unit, 37 denotes an image printing unit, and 38 denotes a bus line for transferring various data.

More specifically, the image data input unit 31 receives multi-valued image data from image input devices such as scanner and digital camera and from hard disks of personal computers. The operation unit 32 has various keys for setting parameters and for specifying a start of printing operation. The CPU 33 controls the whole printing apparatus according to programs in the storage media. The storage media 34 store programs for operating the printing apparatus, including a control program and an error processing program. Operations in this embodiment all conform to these programs. The storage media 34 storing such programs include ROM, FD, CD-ROM, HD and memory card and magnetooptical disc. The RAM 35 is used as a work area for various programs in the storage media 34, as a temporary data saving area during error processing, and as a work area during image processing. The RAM 35 may also be used to copy tables from the storage media 34 and change contents in the tables, making it possible to perform image processing while referring to the changed tables.

The image data processing unit 36 quantizes the received multi-valued image data into N-valued image data for each pixel and generates an ink ejection pattern corresponding to a grayscale value "K" represented by each of the quantized pixels. That is, after the received multi-valued image data has been converted into the N-valued image data, an ejection pattern corresponding to the grayscale value "K" is generated. If 8-bit (256-grayscale) multi-valued image data, for example, is input to the image data input unit 31, the image data processing unit 36 converts a grayscale value of output image data into 25 (=24+1)-value data. While this example employs a multi-valued error spreading technique in converting the input grayscale image data into K-valued data, other half-tone processing methods may also be used, such as an average density storing method and a dither matrix method. Further, repetitively performing the K-value conversion processing based on image density information for all pixels produces a binary drive signal (ink ejection/non-ejection signal) for each nozzle 25 for all pixels.

Based on the ejection pattern generated by the image data processing unit 36, the image printing unit 37 ejects ink from the corresponding nozzles 25 to form a dot image on a print medium. The bus line 38 transfers address signals, data and control signals in the apparatus.

Next, by referring to FIG. 4 to FIG. 13, an arrangement and driving of nozzles and an actual printing operation using a print head will be explained.

First, print data can be generated by a method commonly used in ordinary ink jet printers. In this embodiment an input image is color-separated into several images that are assigned to the print heads of the corresponding colors. The color-separated grayscale images are then binarized by the error spreading method to generate print data to be printed by the print heads of the corresponding ink colors.

Figure 4:
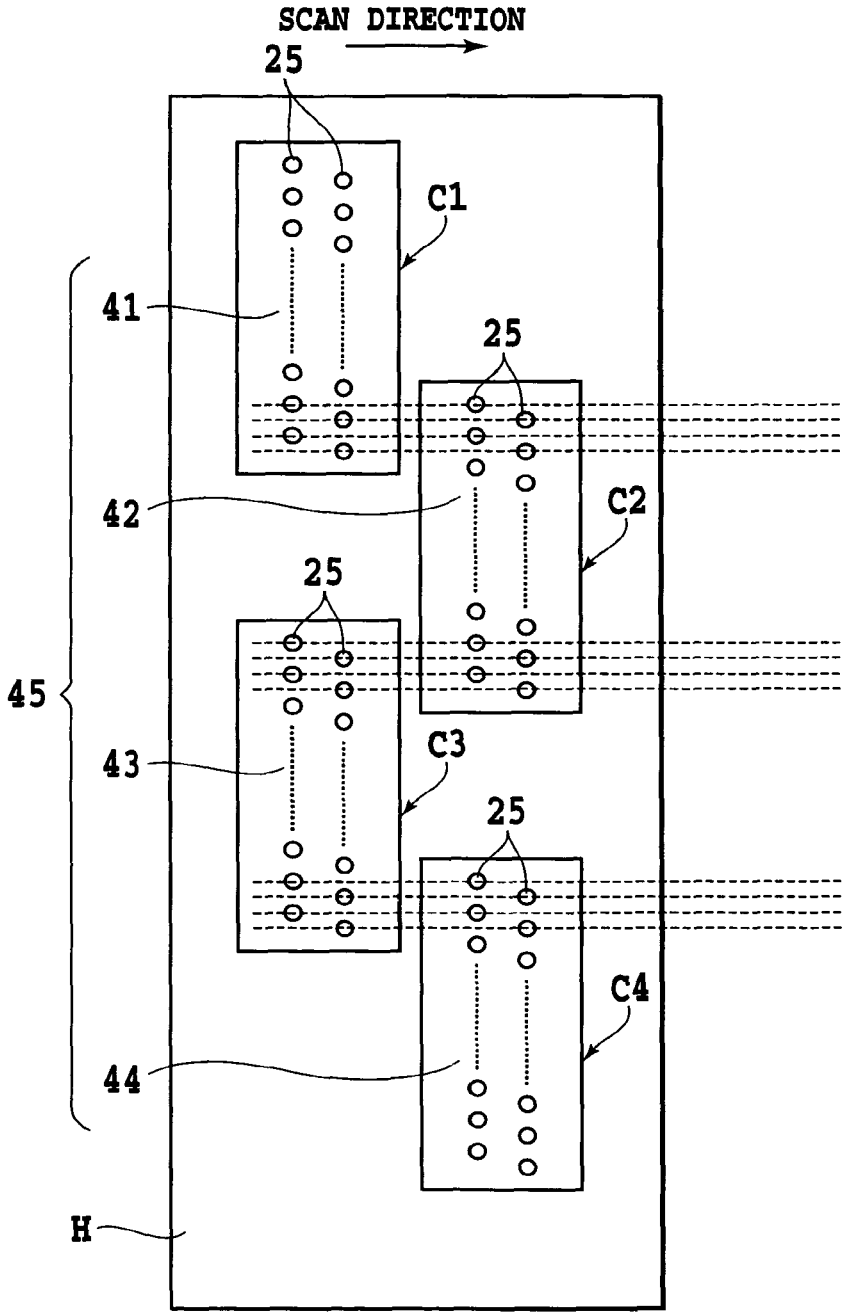
FIG. 4 is an explanatory diagram showing an arrangement of nozzle groups in the print head to which the present invention is applicable.

FIG. 4 schematically shows an arrangement of a plurality of nozzle groups in a full multi-type, elongate print head that applies the present invention.

The full multi-type, elongate print head H of this example comprises a plurality of chips (also referred to as subheads or small heads) C1, C2, C3, and C4 having relatively short columns of nozzles (smaller numbers of nozzles) 41, 42, 43, and 44. These chips C1, C2, C3, and C4 are arranged in a nozzle column direction to form an elongate nozzle group 45. The nozzle groups 41, 42, 43, and 44 each comprise two nozzle columns (left and right nozzle columns) that are spaced from each other in the scan direction. The left and right nozzle columns have a plurality of nozzles 25 arranged at equal pitches and are staggered a half pitch from each other in the nozzle column direction.

Figure 5:
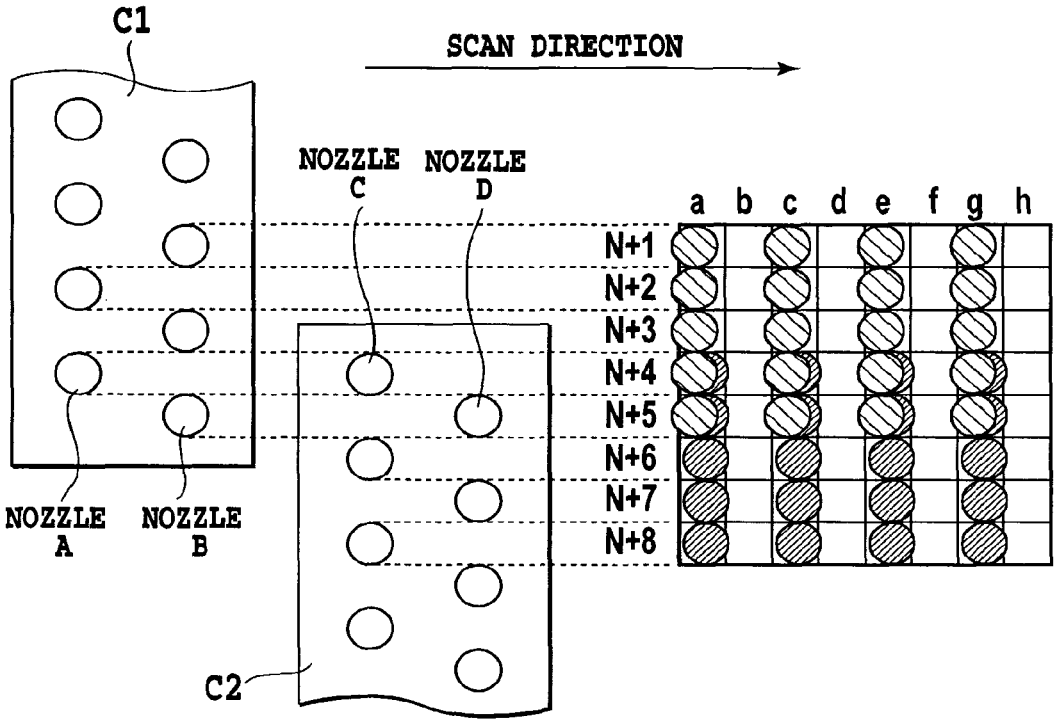
FIG. 5 is an explanatory diagram showing a positional relation between nozzles at a joint portion of the print head, to which the present invention is applicable, and ink dots formed by ink ejected from these nozzles.

The chips C1, C2, C3, C4 are arranged to set their nozzle groups 41, 42, 43, 44 in a positional relation between them such that at least two nozzles at end portions of different nozzle groups are aligned in the scan direction (i.e., their printing positions overlap in the scan direction). The number of overlapping nozzles is set equal to an integer times the number of drive blocks, as described later. Ink droplets ejected from the overlapping nozzles therefore land on the same print matrix positions on the print medium when a printing operation is done by moving the print head H and the print medium relative to each other in the scan direction. For example, if the number of overlapping nozzles is set to 2 to match the number of drive blocks of 2, as shown in FIG. 5, ink droplets ejected from a nozzle A of the overlapping chip C1 and from a nozzle C of the overlapping chip C2 land on matrix positions (N+4, a), (N+4, c), (N+4, e) and (N+4, g) on the print medium to form ink dots there. Also, ink droplets ejected from a nozzle B of the chip C1 and from a nozzle D of the chip C2 land on matrix positions (N+5, a), (N+5, c), (N+5, e), (N+5, g) to form ink dots there.

Figure 6:
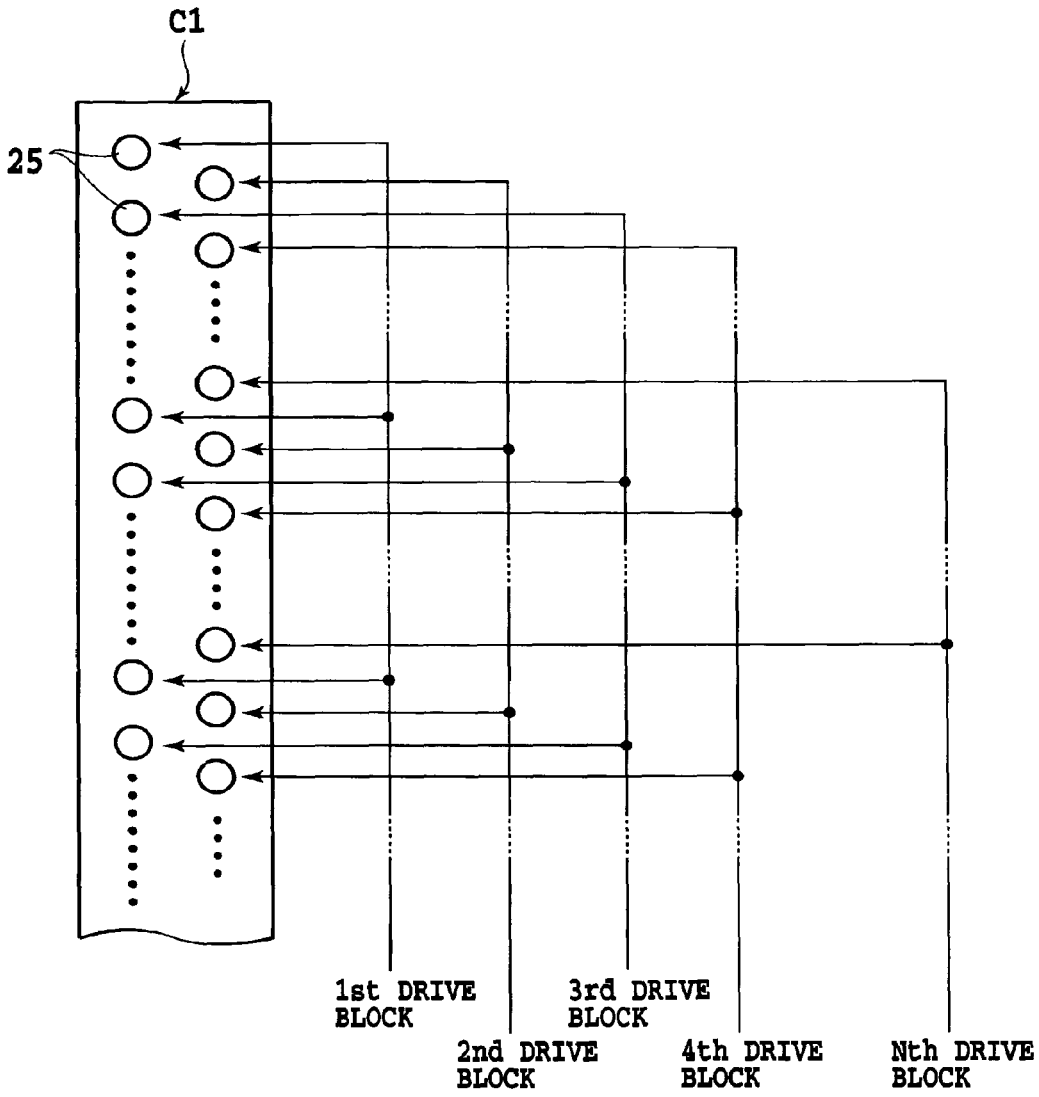
FIG. 6 illustrates an allocation of drive blocks in a print head that are driven on a time-division basis.
Figure 7:
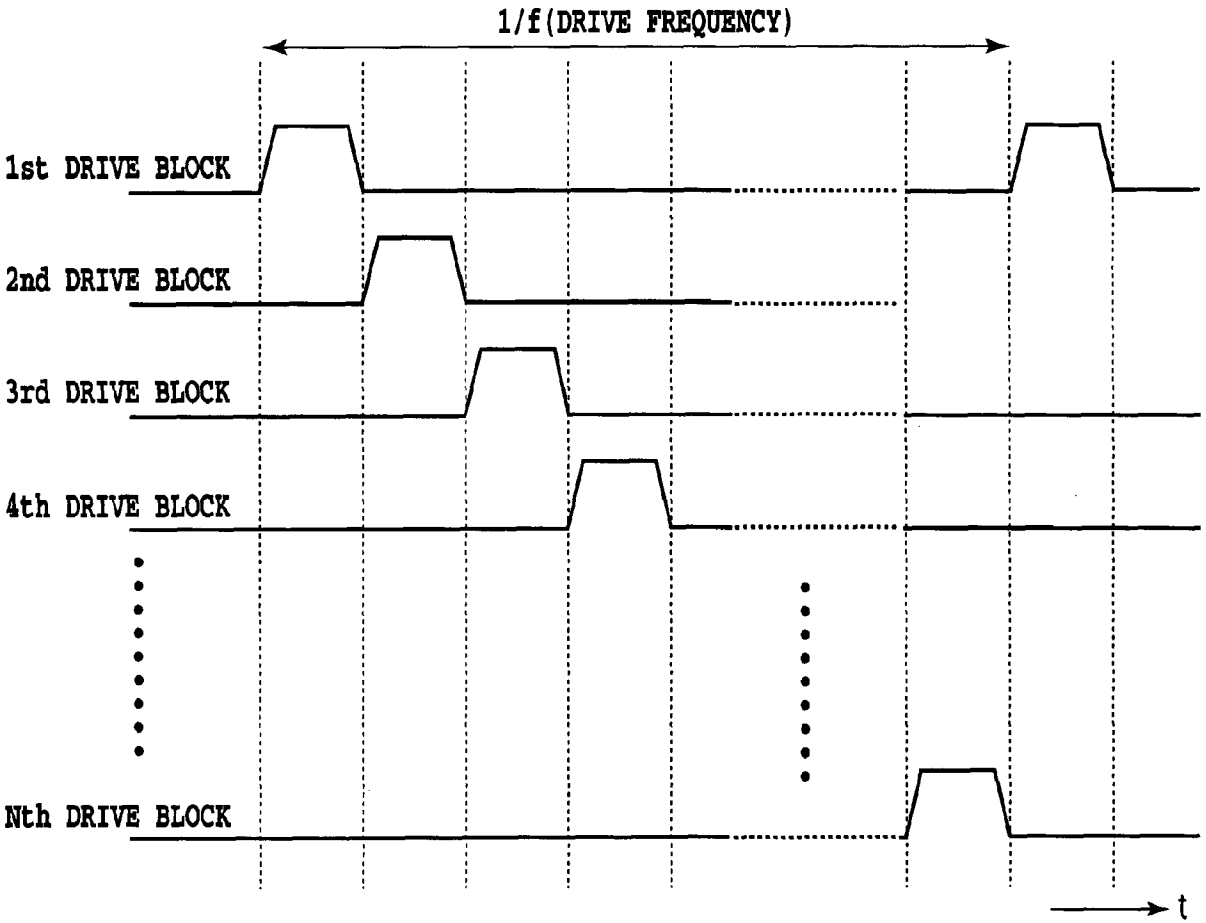
FIG. 7 is a timing chart showing a time-division operation of the print head of FIG. 6.

FIG. 6 illustrates a method of driving nozzle blocks to eject ink from nozzles 25 in an example chip C1, which has relatively short columns of nozzles (small number of nozzles) and forms a part of the elongate print head H.

The chip C1 is constructed so that heaters 22 of the print elements are activated on a time-division basis to eject ink from the nozzles 25. If the ink jet print elements in the chip C1 are driven ("nozzle driving" or "nozzle activation") at the same time, a maximum power consumption becomes large, thus requiring a power supply with a large current capacity. To keep the power consumption from rising by limiting the number of print elements to be driven simultaneously, the print elements at the nozzles of the chip are divided into a plurality of groups (or blocks). As shown in the timing chart of FIG. 7, the blocks of print elements are activated sequentially from one block to another, with block heater start timings staggered slightly. When a plurality of chips are to be activated, it is common either to drive all the chips simultaneously or shift the drive timing among the chips.

When an elongate print head is used, the total number of print elements in the print head is very large and therefore the current capacity becomes extremely high. Driving such a print head with a power supply of small current capacity requires this time-division driving of the print elements.

Figure 8:
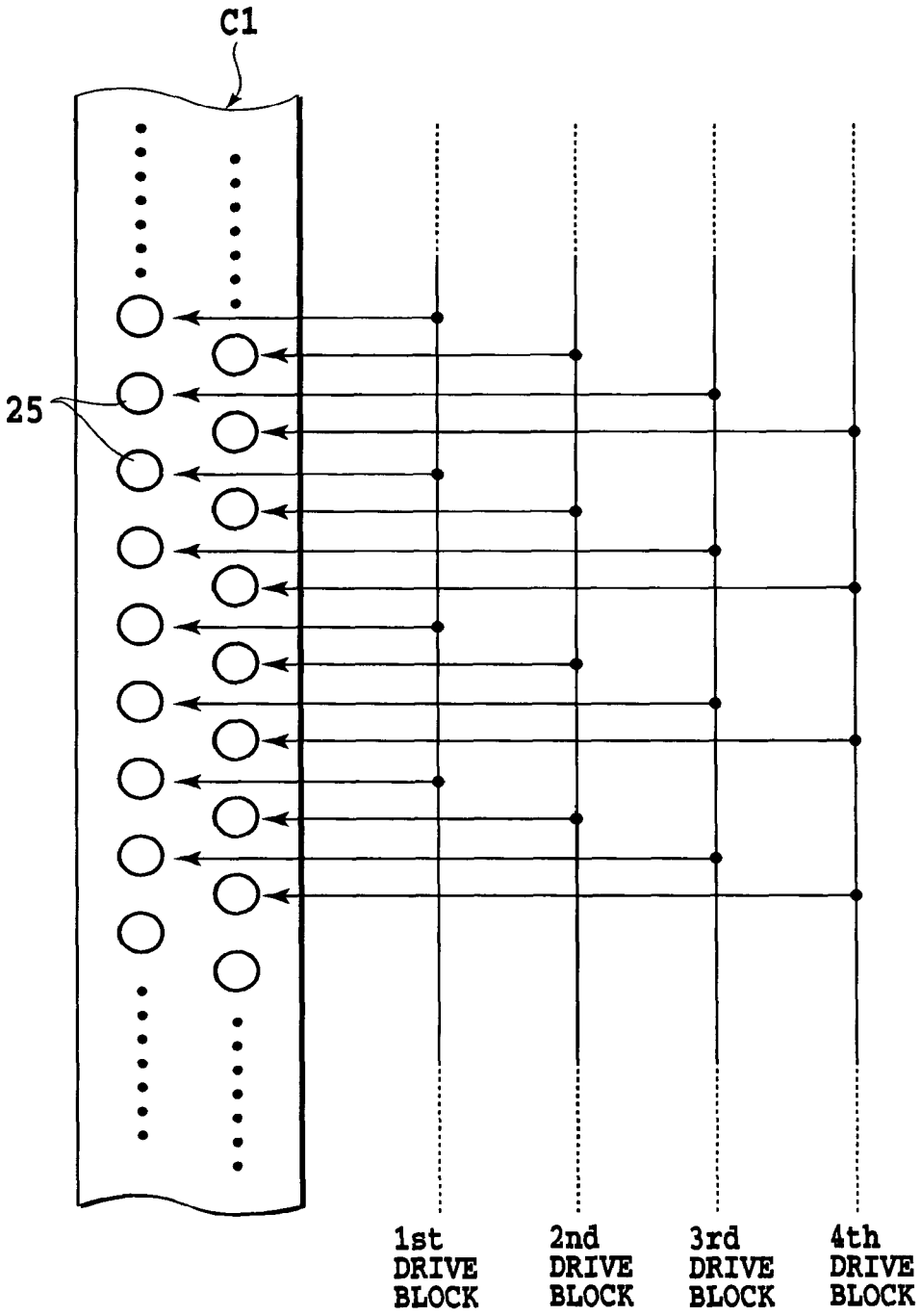
FIG. 8 illustrates an allocation of four drive blocks in a print head that are driven on a time-division basis.
Figure 9:
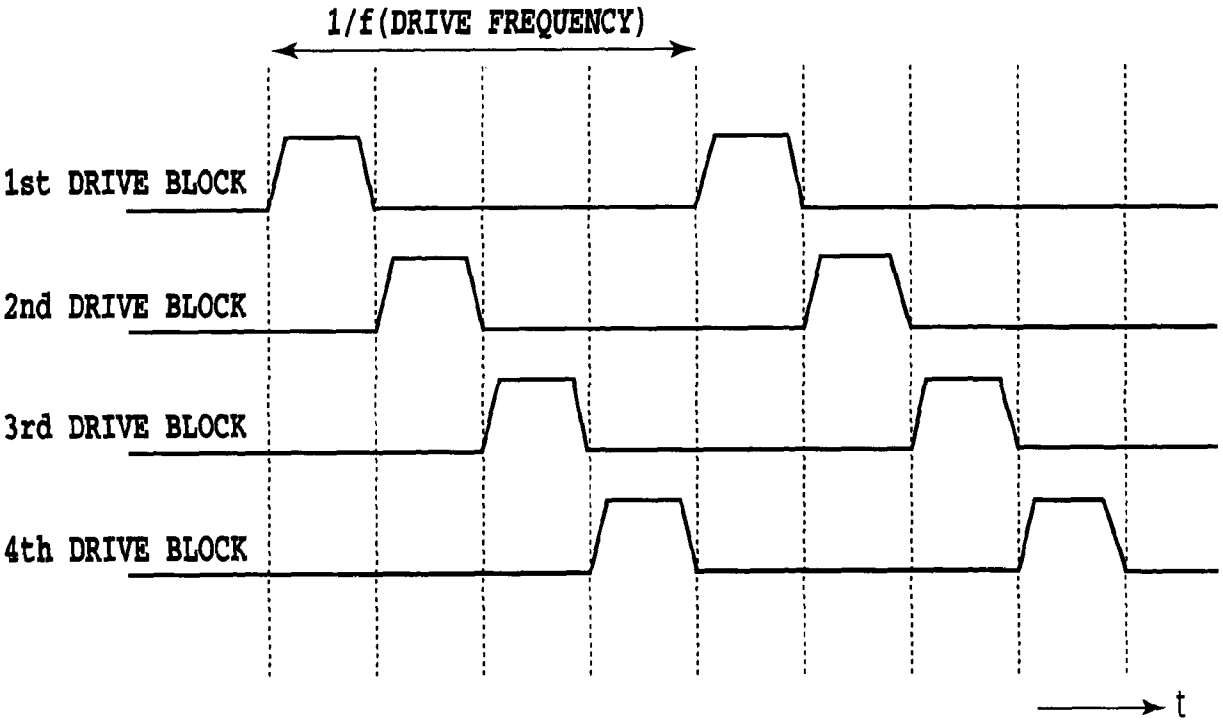
FIG. 9 is a timing chart showing a time-division operation of the print head of FIG. 8.

FIG. 8 illustrates a time-division driving method for activating print elements of the chip C1 in four separate blocks (nozzle groups) on a time-division basis. FIG. 9 is a timing chart of the time-division operation. The nozzles are assigned to the first, second, third and fourth drive block according to the order of arrangement in the nozzle column direction. Those nozzles assigned to the same drive block eject ink at the same timing.

Figure 10:
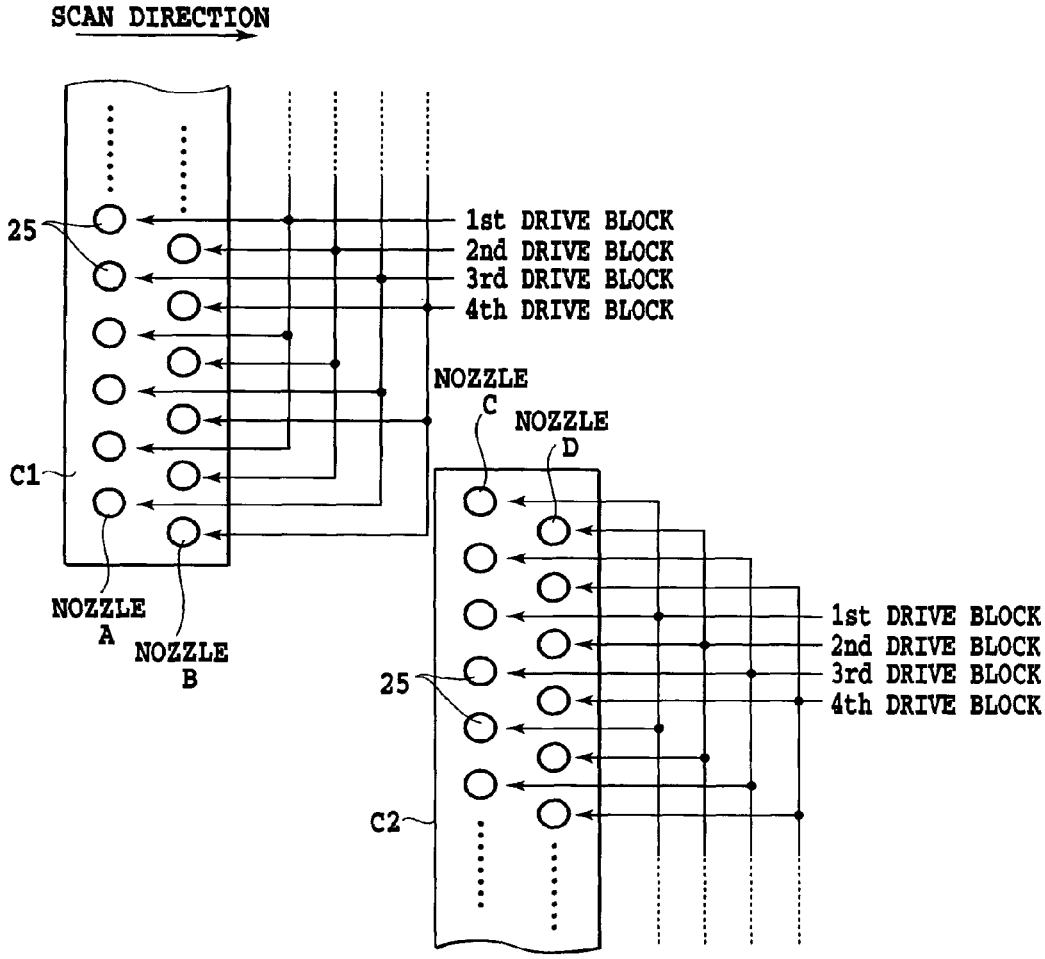
FIG. 10 illustrates an example allocation of four drive blocks in a print head that are driven on a time-division basis, for comparison with the embodiment of the present invention.

FIG. 10 shows another example for comparison with the above embodiment of the present invention. This example illustrates a drive method which applies the time-division activation (four-block activation) technique of FIG. 8 and FIG. 9 in the subhead (head chip) configuration of FIG. 5, in which a plurality of chips (C1, C2, C3, and C4) are arranged so that adjoining chips overlap each other by two nozzles at their end portions. In this example, the overlapping nozzles A, B of the chip C1 are assigned to the associated drive blocks in the same order as other nozzles of the chip. Similarly, in the chip C2 the overlapping nozzles C, D are assigned to the associated drive blocks in the same order as other nozzles of the chip. Therefore, the overlapping nozzle A of the chip C1 and the overlapping nozzle C of the chip C2 are assigned to the third drive block and the first drive block, respectively. The overlapping nozzle B of the chip C1 and the overlapping nozzle D of the chip C2 are assigned to the fourth drive block and the second drive block, respectively.

Figure 11:
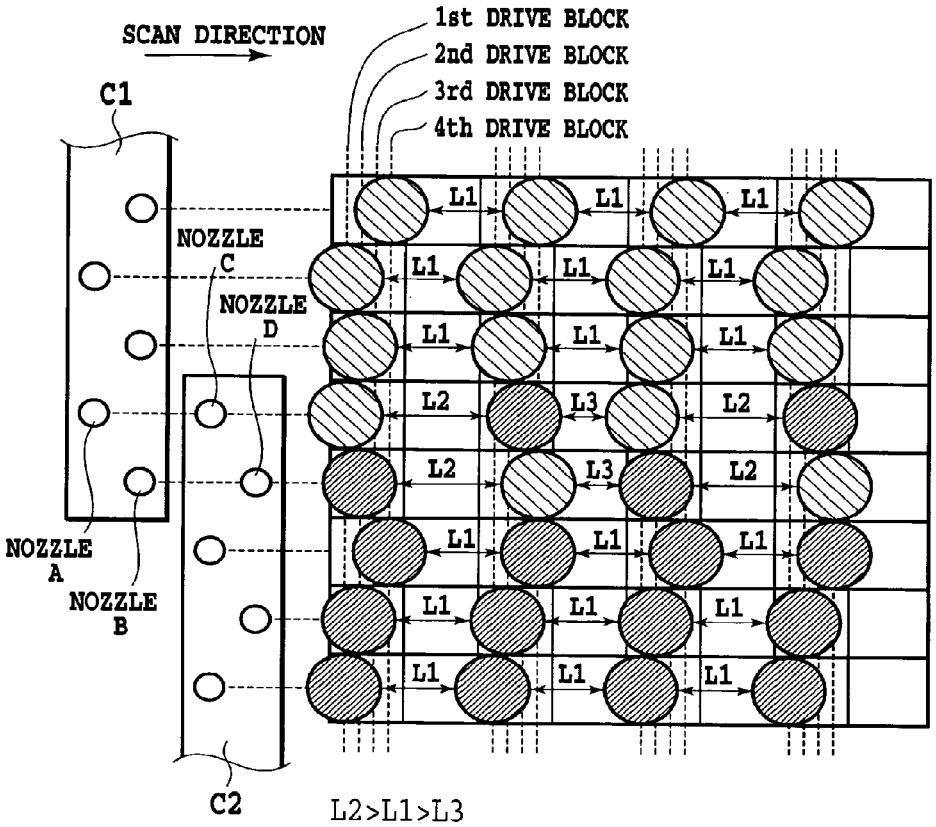
FIG. 11 is an explanatory diagram showing a positional relation between nozzles at a joint portion of the print head of FIG. 10 and ink dots formed by ink ejected from these nozzles.

FIG. 11 is an explanatory diagram showing dots printed by the print head with drive blocks assigned as the comparative example shown in FIG. 10. In this example, the overlapping nozzles A and C eject ink alternately (ejection ratio of 1:1) and the overlapping nozzles B and D also eject ink alternately (ejection ratio of 1:1) to form ink dots on a print matrix on a print medium. As can be seen from FIG. 11, since the overlapping nozzles A, C and nozzles B, D are assigned different drive blocks, their heater start timings differ. The differences in the heater start timing among the overlapping nozzles result in ink droplets ejected from the overlapping nozzles landing at slightly different positions. Intervals between the ink dots formed on a print medium by other than the overlapping nozzles are all L1 while intervals between the ink dots formed by the overlapping nozzles are L2 or L3 (L2>L1>L3). When a printed result is visually checked, density variations that look like stripes or Moirè patterns are observed in areas printed by the overlapping nozzles that are situated at joint portions of the head chips.

Figure 14:
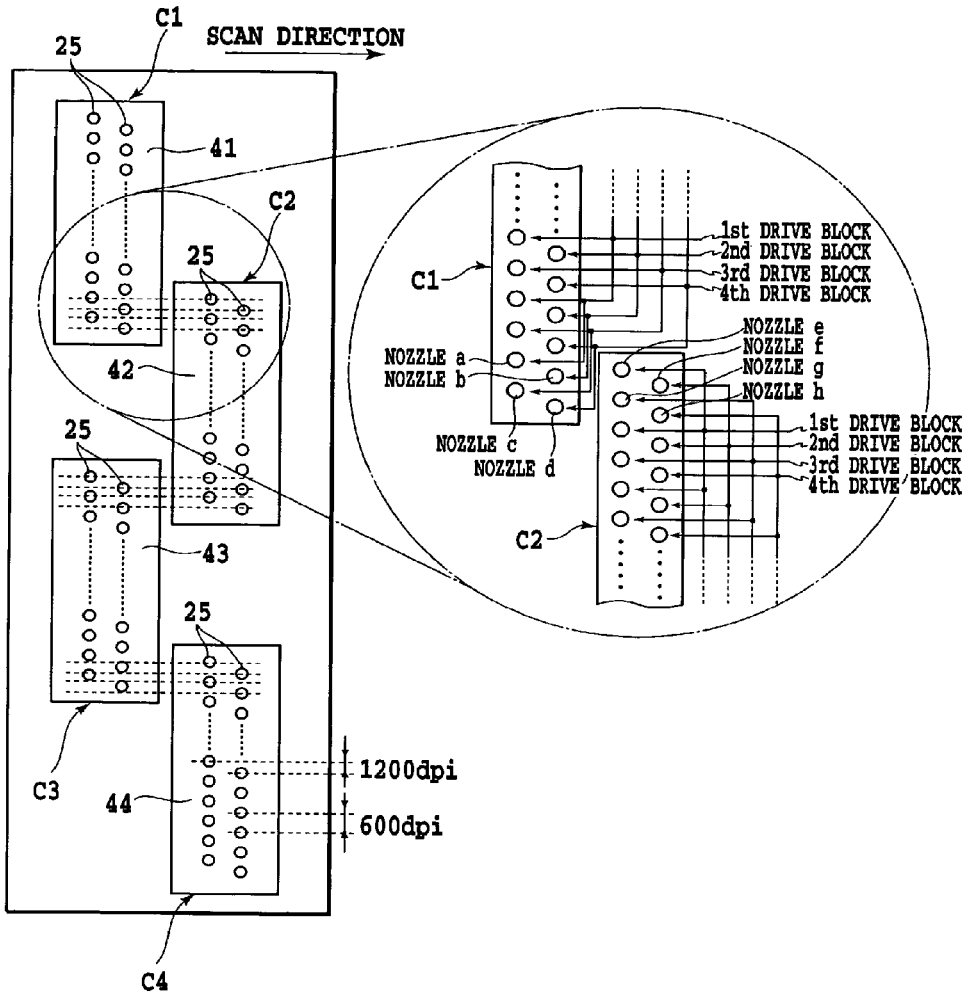
FIG. 14 illustrates a construction of the print head as Embodiment 1 of the present invention and an allocation of four drive blocks in the print head that are driven on a time-division basis.

FIG. 14 illustrates a first embodiment of the present invention. This embodiment applies the time-division operation (four drive blocks) of FIG. 8 and FIG. 9 in a head unit which has a plurality of head chips (C1, C2, C3, and C4) arranged so that end portions of the adjoining head chips overlap by four nozzles. It is noted that the number of overlapping nozzles (4) is equal to an integer (1) times the number of drive blocks (4).

Figure 12:
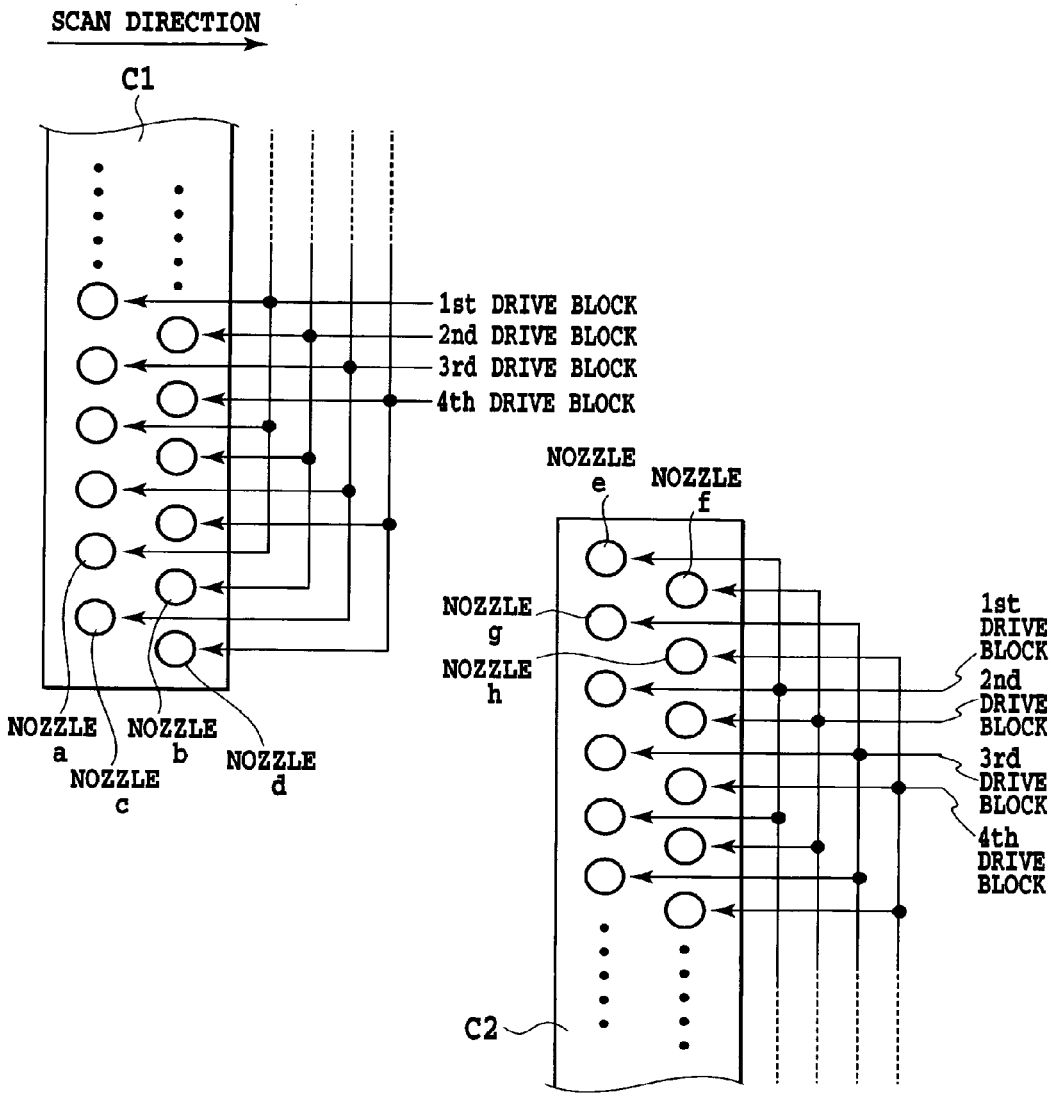
FIG. 12 is an explanatory diagram, as a first embodiment of the present invention, showing an allocation of four drive blocks in a print head that are driven on a time-division basis.

In this embodiment, the overlapping nozzles are allocated to the same drive block. That is, as shown in FIG. 12, the overlapping nozzle a of the chip C1 and the overlapping nozzle e of the chip C2 are allocated to the first drive block. Similarly, the overlapping nozzles b and f are assigned to the second drive block; the overlapping nozzles c and g are assigned to the third drive block; and the overlapping nozzles d and h are assigned to the fourth drive block. As can be seen from the above, the overlapping nozzles are allocated to drive blocks in the same way as with the other nozzles. In this embodiment, the number of sets of overlapping nozzles (print elements), as counted in the nozzle column direction, is equal to the number of drive blocks, the former being equal to an integer (1) times the latter. Thus, the allocation of the drive blocks to the overlapping nozzles is made in the same order as with the drive block allocation of other nozzles. For example, as indicated by drive block allocation lines of FIG. 12, by forming a circuit for drive signal (drive circuit) for each ink jet print element (in this embodiment, a drive signal circuit for the heater 22), it is possible to allocate drive blocks to all nozzles and set nozzle drive timings to the same timing for each drive block. Further, since the order of allocation of the drive blocks to the overlapping nozzles is the same as with the other nozzles, the drive circuit for the ink jet print elements can be formed as a fixed pattern repeating itself in the arrangement direction of the ink jet print elements. Rather than using such drive circuits, it is possible to control individual ink jet print elements, assign drive blocks to all nozzles and set nozzle drive timings to the same timing for each drive block.

Figure 13:
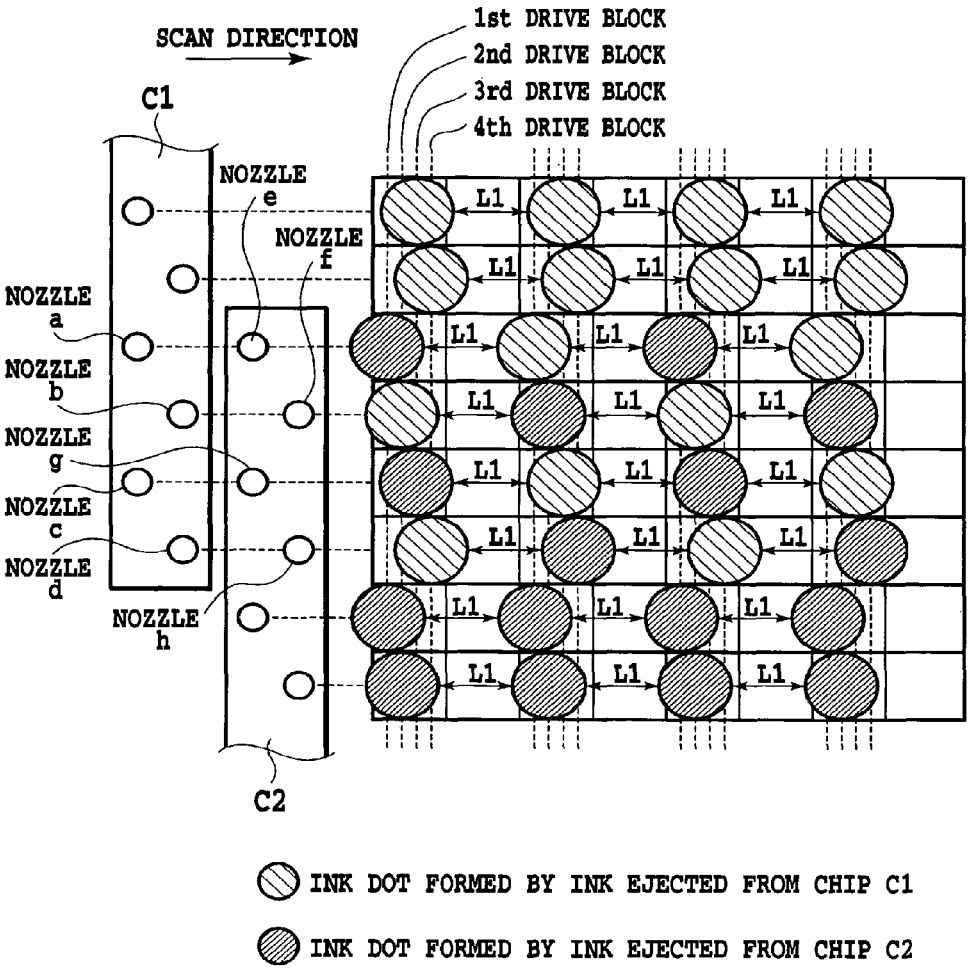
FIG. 13 is an explanatory diagram showing a positional relation between nozzles at a joint portion of the print head of FIG. 12 and ink dots formed by ink ejected from these nozzles.

FIG. 13 is an explanatory diagram showing ink dots formed by the print head with the drive blocks assigned as shown in FIG. 12. In this example, the overlapping nozzles are made to eject ink alternately (ejection ratio of 1:1) to form ink dots on a print matrix on a print medium. As can be seen from FIG. 13, since the number of overlapping nozzles and the number of drive blocks are equal, the heater start timings of the overlapping nozzles are the same. In this example, too, no deviations occur in the landing position between the ink droplets ejected from the overlapping nozzles. A visual check on a printed result does not reveal any density variations in the form of stripes or Moirè patterns in areas printed by the overlapping nozzles that are situated at the joint portions of the adjoining chips.

Other Embodiments

The number of overlapping nozzles at the joint portions of the adjoining chips can be set to a desired one. Depending on the number set, more or less complex construction and setting may need to be adopted for the drive circuits. However, by determining the number of sets of overlapping nozzles according to the number of drive blocks, as in the first embodiment, it is possible to eliminate deviations in the ink droplet landing position without having to modify the configuration of the drive circuits. That is, as indicated by the drive block allocation lines of FIG. 12, if drive signal circuits for individual ink jet print elements (in this example, drive signal circuits for heaters 22) are formed, the drive signal circuits that allocate drive blocks to all nozzles in the same order can be used as is. The number of sets of overlapping nozzles can be set optimally according to parameters, such as a length of the print head unit used, the number of chips to be joined, their lengths, the number of blocks to be driven on a time-division basis and a driving rate.

The number of overlapping nozzles is set to an integer times the number of drive blocks. This makes it possible to eliminate ink droplet landing position deviations without changing the configuration of the drive circuits.

In addition to the ink jet print head that incorporates ink jet print elements capable of ejecting ink from their nozzles, other print heads with various kinds of print elements may also be used.

The nozzle group arrangement and the printing system applicable to the present invention are not limited to those described in the above embodiment. Some other examples are described below. It is noted, however, that the present invention is not limited to these examples.

The present invention produces an excellent effect when applied to a printing apparatus using an ink jet print head which, among others, utilizes a thermal energy to expel ink droplets for printing.

As to a representative construction and working principle, such an ink jet printing apparatus preferably use a basic principle described in U.S. Pat. Nos. 4,723,129 and 4,740,796. This system is applicable to both so-called on-demand type and continuous type. The on-demand type is particularly advantageous because of its construction, in which at least one drive signal corresponding to print information is applied to electrothermal transducers arranged in a sheet or liquid paths holding liquid (ink) to generate a thermal energy in the electrothermal transducer to cause a faster temperature increase than a nucleate boiling and generate a film boiling in a heat application surface of the print head, which in turn generates a bubble in ink in a one-to-one correspondence with the drive signal. An expansion and contraction of this bubble ejects at least one ink droplet from the nozzle opening. By forming the drive signal in a pulse-like shape, the bubble expansion and contraction can be achieved instantly and properly, realizing a responsive ink ejection. The pulse-like drive signal is preferably those described in U.S. Pat. Nos. 4,463,359 and 4,345,262. The use of conditions on a rate of temperature rise of the heat application surface described in U.S. Pat. No. 4,313,124 assures a further improved printing.

In addition to these print head constructions described in the above patent specifications which employ a combination of nozzles, liquid paths and electrothermal transducers, the present invention also includes constructions disclosed in U.S. Pat. Nos. 4,558,333 and 4,459,600 in which heat application portions are arranged in bent areas.

In addition to a full line type print head with its length corresponding to a maximum printable width of a print medium, the present invention can also be effectively applied to serial type print heads, such as a print head fixed to an apparatus body, a replaceable print head which, when mounted to the apparatus body, is electrically connected to and supplied with ink from the body, and a cartridge type print head in which ink tanks are integrally attached to the print head.

It is also preferable that the printing apparatus of the present invention be provided with additional means such as a print head ejection performance recovery means and a preliminary auxiliary means since they ensure a more stable performance of the print head. More specifically, these means include head capping means, head cleaning means, pressurization or sucking means, preliminary heating means using electrothermal transducers, other heating elements or a combination of these, and a preliminary ejection means for causing the print head to eject ink prior to printing.

As described above, the present invention can be applied to a system consisting of a plurality of devices (such as host computer, interface, reader, printer, etc) or an apparatus having only a single device (such as copying machine and facsimile).

The present invention also includes a variety of devices connected to an apparatus or system, in which system a series of program codes is supplied to a computer (CPU or MPU) to operate the devices to realize the functions of the aforementioned embodiment.

In this case, since the program codes themselves realize the functions of the above embodiment, the program codes and a means to load the program codes into the computer, such as storage media containing the program codes, constitute the present invention.

Possible storage media for storing the program codes may include, for example, floppy (registered trademark) disks, hard disks, optical discs, magnetooptical discs, CD-ROMs, magnetic tapes, nonvolatile memory cards, and ROMs.

Not only when the functions of the above embodiment are realized by the computer executing the loaded program codes but also when they are implemented by the program codes in cooperation with an operating system running on the computer or with other application programs, the program codes are included in the present invention.

The present invention also includes program codes when the supplied program codes are first stored in a memory installed in a computer function expansion board or in a function expansion unit connected to the computer and then a CPU in the function expansion board or function expansion unit executes a part or all of processing according to the instructions of the program codes to realize the function of the above embodiment.

The invention will be described in more detail by referring to specific examples.

Example 1

As an elongate print head for use in this embodiment, an ink jet print head with four chips C1, C2, C3, and C4, as shown in FIG. 14, was prepared. Nozzle groups 41, 42, 43, and 44 in these chips C1, C2, C3, and C4 each have 128 nozzles 25 arrayed in two columns, left and right, at an interval of 600 dpi (about 42.5 μm). The nozzles 25 in the left and right columns are shifted half-pitch (1200 dpi) from each other in the nozzle column direction. Thus, the print head in this embodiment has a total of 512 nozzles. Further, the four chips C1, C2, C3, and C4 are also arranged to overlap each other by four nozzles at the joint portions.

The nozzles in each of the chips C1, C2, C3, C4 are divided into groups of four which are allocated to four drive blocks (first, second, third and fourth drive block), as in the above embodiment of the present invention. The nozzles are driven in the order of the first, second, third and fourth drive block. Thus the number of overlapping nozzles (4) is equal to an integer (1) times the number of drive blocks (4). As in the embodiment of FIG. 12 and FIG. 13, the overlapping nozzles are assigned to the same drive block. That is, the overlapping nozzle a of the chip C1 and the overlapping nozzle e of chip C2 are assigned to the first drive block. Likewise, the nozzle b and nozzle f are assigned to the second drive block, the nozzle c and nozzle g are assigned to the third drive block and the nozzle d and nozzle h are assigned to the fourth drive block. In this example, since the number of overlapping nozzles and the number of drive blocks are equal, the drive block allocation to the overlapping nozzles is made in the same order as with the other nozzles.

Since the number of overlapping nozzles and the number of drive blocks are equal as described above, the drive timings of the overlapping nozzles agree when the overlapping nozzles are activated successively according to the drive timings of the four drive blocks, which are allocated in the same order as with the other nozzles. This holds true also when the number of overlapping nozzles is two or greater integer times the number of drive blocks.

Then, the arrangement interval between the chips C1, C2, C3, and C4 is adjusted and the overall drive timing of the whole print head is adjusted to ensure that the ink droplets land in the same way as in FIG. 13. An image was printed using this print head and a visual check on the printed image did not reveal any density variations in the form of stripes or bands or Moirè patterns in areas printed by the overlapping nozzles that are situated in the joint portions of the chips. Line patterns consisting of various forms of lines were printed using the overlapping nozzles and the printed lines were found to have a good quality.

In printing an image, a printing apparatus of the same construction as FIG. 1 was used and the print head of FIG. 14 was installed as print heads 1, 2, 3, and 4.

These print heads were activated to eject ink droplets of 5.0±0.5 pl from the nozzles 25. As inks containing colorants, inks for ink jet printer BJF870 (Canon make) available on the market were used. For a print medium 5, ink jet-dedicated photo-glossy paper (Prophotopaper, PR-101: Canon make) was prepared.

To describe in more detail, a print head drive rate was set to 8 kHz as an ink droplet ejection frequency. As for images to be printed, we prepared images that would result in 5.0-pl ink droplet print duty of 100%, 75%, 50%, and 25% and a photographic quality image. If a square print matrix of 1200-dpi pixels is printed at the ejection drive frequency of 8 kHz, reference ejection timing for each nozzle is 125 μsec. Ink droplets are ejected from the nozzles at this reference ejection timing. In this example, since the nozzles of each chip C1, C2, C3, and C4 are divided into four drive blocks, the ink ejection timings of the four drive blocks were shifted about 31 μsec (=125 μsec/4 blocks) from each other. In a printing operation, for the overlapping nozzles to eject ink alternately, ejection data was distributed so that the ejection ratio between the overlapping nozzles would be 1:1.

Under these conditions, the prepared images of different print duties were printed in one scan. No density variations in the form of stripes or bands or Moirè patterns were observed in areas printed by the overlapping nozzles that were situated at joint portions of the chips and the printed quality was satisfactory. The photographic image was also printed in the similar way and those areas printed by the overlapping nozzles at the joint portions of the chips were not distinguishable. The quality of the printed image was also satisfactory.

Example for Comparison with Embodiment 1

Figure 15:
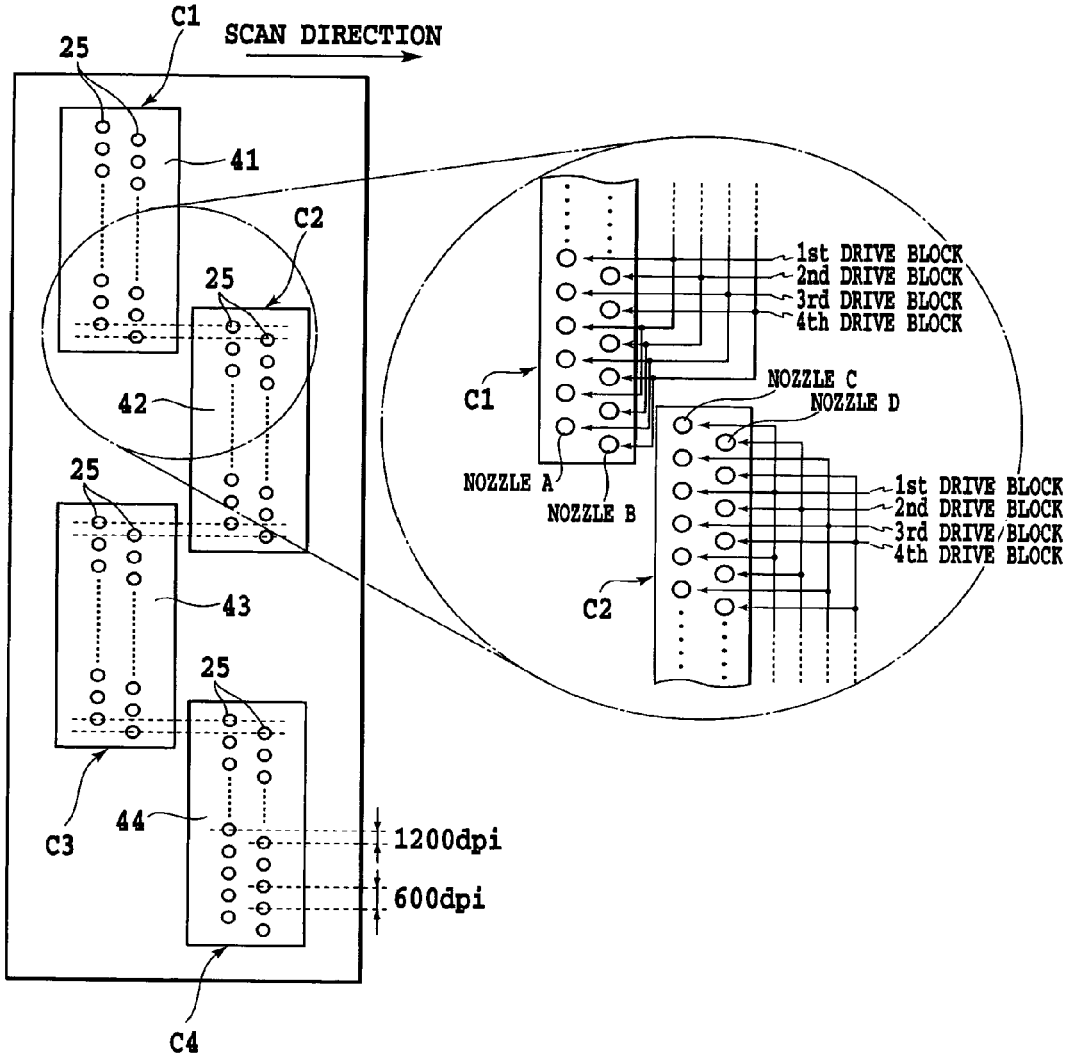
FIG. 15 illustrates a construction of a print head for comparison with the embodiment of the present invention and an allocation of four drive blocks in the print head that are driven on a time-division basis.

As an elongate print head for use in this example to be compared with Embodiment 1 of the present invention, an ink jet print head with four chips C1, C2, C3, and C4, as shown in FIG. 15, was prepared. Nozzle groups 41, 42, 43, and 44 in these chips C1, C2, C3, and C4 each have 128 nozzles 25 arrayed in two columns, left and right, at an interval of 600 dpi (about 42.5 μm). The nozzles 25 in the left and right columns are shifted half-pitch (1200 dpi) from each other in the nozzle column direction. Thus, the print head in this example has a total of 512 nozzles. Further, the four chips C1, C2, C3, and C4 are also arranged to overlap each other by two nozzles at the joint portions.

The nozzles in each of the chips C1, C2, C3, and C4 are divided into groups of four which are allocated to four drive blocks (first, second, third, and fourth drive block), as in the above embodiment of the present invention. The nozzles are driven in the order of the first, second, third and, fourth drive block. Therefore, the number of overlapping nozzles (2) is not equal to an integer times the number of drive blocks (4). As in the example of FIG. 10 and FIG. 11, the allocation of the drive blocks to the overlapping nozzles is made in the same order as with the other nozzles. Thus, the drive blocks allocated to the overlapping nozzles differ. That is, the nozzle A is assigned to the third drive block and the nozzle C to the first drive block. As for the overlapping nozzles B and D, the nozzle B is assigned to the fourth drive block and the nozzle D to the second drive block.

Then, the arrangement interval between the chips C1, C2, C3, and C4 is adjusted and the overall drive timing of the whole print head is adjusted to ensure that the ink droplets land in the same way as in FIG. 11.

In printing an image, a printing apparatus of the same construction as FIG. 1 was used and the print head of FIG. 15 was installed as print heads 1, 2, 3, and 4. A printing operation was performed under the same conditions as those of the above Embodiment 1 except for the print heads. In the printing operation, for the overlapping nozzles to eject ink alternately, ejection data was distributed so that the ejection ratio between the overlapping nozzles would be 1:1.

Under these conditions, the prepared images of different print duties were printed in one scan as in the above Embodiment 1. Image degradations such as density variations in the form of stripes or bands or Moirè patterns were observed in areas printed by the overlapping nozzles that were situated at joint portions of the chips. This is caused for the following reasons. The overlapping nozzles A and C are driven by the third drive block and the first drive block, respectively, to eject ink at different timings, and the overlapping nozzles B and D are driven by the fourth and second drive block, respectively, to eject ink at different timings. This results in a small deviation in the ink droplet landing position between the overlapping nozzles. The landing position deviation for the print head of this example is about 15 μm at maximum depending on a combination of different drive blocks. This landing position deviation in turn results in small blanked areas where no ink dots are formed or small high-density areas where ink dots are concentrated. With these density variations occurring intermittently in the scan direction, the density variations are easily recognized, further degrading the image quality.

A photographic image was also printed in the similar manner. Those areas printed by the overlapping nozzles situated at joint portions of the chips were distinguishable because of their degraded image quality.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A printing apparatus comprising:

a print head having first and second chips on each of which a plurality of print elements are aligned in a predetermined direction, the plurality of print elements in the first chip and the plurality of print elements in the second chip being deviated from each other in a direction crossing the predetermined direction, the first chip having a first portion that is part of the plurality of print elements, the second chip having a second portion that is part of the plurality of print elements, the first portion and the second portion being overlapped in the predetermined direction, the first portion including a first print element, and the second portion including a second print element;

a driving unit configured to time-divisionally drive the plurality of print elements in the first chip and the plurality of print elements in the second chip, the first print element and the second print element being driven at the same timing; and a scanning unit configured to perform a printing scan by moving a print medium relative to the print head in a scanning direction crossing the predetermined direction, wherein a print position printed by the first print element and a print position printed by the second print element correspond to each other in the scanning direction.

2. The printing apparatus according to claim 1, wherein the print position printed by the first print element and the print position printed by the second print element exist on a same scanning line in the print medium.

3. The printing apparatus according to claim 1, wherein the first print element and the second print element are arranged on a same scanning line in the print head.

4. The printing apparatus according to claim 1, wherein the driving unit has a plurality of drive blocks having different driving timings, and wherein each of the plurality of print elements in the first and second chips is allocated to any of the plurality of drive blocks.

5. The printing apparatus according to claim 4, wherein the number of the print elements in each of the first and second portions corresponds to an integer times the number of the drive blocks.

6. The printing apparatus according to claim 4, wherein the first print element and the second print element are allocated to the same block in the plurality of drive blocks.

7. The printing apparatus according to claim 1, wherein the plurality of print elements in the print head are arranged to span an entire print area of the print medium in a width direction of the print medium.

8. The printing apparatus according to claim 1, wherein the print element has a heater and a nozzle, the heater being driven by the driving unit to cause the nozzle to eject an ink.

9. A printing apparatus comprising:

a print head having first and second chips on each of which a plurality of print elements are aligned in a predetermined direction, the plurality of print elements in the first chip and the plurality of print elements in the second chip being deviated from each other in a direction crossing the predetermined direction, the first chip having a first portion that is part of the plurality of print elements, the second chip having a second portion that is part of the plurality of print elements, the first portion and the second portion being overlapped in the predetermined direction, the first portion including a first print element, and the second portion including a second print element;

a driving unit configured to time-divisionally drive the plurality of print elements in the first chip and the plurality of print elements in the second chip, the first print element and the second print element being driven at the same timing; and a moving unit configured to perform relative movement between the print head and a print medium in a moving direction across the predetermined direction so as to print image on the print medium, wherein a print position printed by the first print element and a print position printed by the second print element correspond to each other in the scanning direction.

10. The printing apparatus according to claim 9, wherein the print position printed by the first print element and the print position printed by the second print element exist on a same scanning line in the print medium.

11. The printing apparatus according to claim 9, wherein the first print element and the second print element are arranged on a same moving line in the print head.

12. The printing apparatus according to claim 9, wherein the driving unit has a plurality of drive blocks having different driving timings, and wherein each of the plurality of print elements in the first and second chips is allocated to any of the plurality of drive blocks.

13. The printing apparatus according to claim 12, wherein the number of the print elements in each of the first and second portions corresponds to an integer times the number of the drive blocks.

14. The printing apparatus according to claim 12, wherein the first print element and the second print element are allocated to the same block in the plurality of drive blocks.

15. The printing apparatus according to claim 9, wherein the plurality of print elements in the print head are arranged to span an entire print area of the print medium in a width direction of the print medium.

16. The printing apparatus according to claim 9, wherein the print element has a heater and a nozzle, the heater being driven by the driving unit to cause the nozzle to eject an ink.

17. The printing apparatus according to claim 9, wherein the moving unit moves the print head relative to the print medium in the moving direction.

18. A printing apparatus comprising:

a print head having first and second chips, on each of which a plurality of print elements are aligned in a predetermined direction, the plurality of print elements in the first chip being staggered with respect to each other in the predetermined direction, the plurality of print elements in the second chip being staggered with respect to each other in the predetermined direction, the first chip having a first portion of the plurality of print elements, the second chip having a second portion of the plurality of print elements, the first portion and the second portion overlapping in the predetermined direction, the first portion including a first print element, and the second portion including a second print element;

a driving unit configured to time-divisionally drive the plurality of print elements in the first chip and the plurality of print elements in the second chip, the first print element and the second print element being driven at the same timing; and a scanning unit configured to perform a printing scan by moving a print medium relative to the print head in a scanning direction crossing the predetermined direction, wherein a print position printed by the first print element and a print position printed by the second print element correspond to each other in the scanning direction.

* * * * *